US007493790B2

(12) United States Patent
Heinicke

(10) Patent No.: US 7,493,790 B2
(45) Date of Patent: Feb. 24, 2009

(54) PROCESS OF MAKING EASY OPEN CAN END

(75) Inventor: Paul R. Heinicke, Canton, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 62 days.

(21) Appl. No.: 11/329,604

(22) Filed: Jan. 11, 2006

(65) Prior Publication Data

US 2006/0113306 A1 Jun. 1, 2006

Related U.S. Application Data

(62) Division of application No. 10/798,069, filed on Mar. 11, 2004, now Pat. No. 7,147,122.

(51) Int. Cl.
*B21D 11/00* (2006.01)
*B21D 22/00* (2006.01)
*B21D 51/44* (2006.01)

(52) U.S. Cl. ..... 72/379.4; 72/349; 413/12

(58) Field of Classification Search ..... 72/347, 72/348, 349, 350, 379.4; 413/8, 12, 14, 15, 413/16, 17, 56, 67
See application file for complete search history.

(56) References Cited

U.S. PATENT DOCUMENTS 3,765,352 A 10/1973 Schubert et al.
3,825,149 A 7/1974 Brown et al.
3,853,080 A 12/1974 Zundel
3,871,314 A 3/1975 Stargell
3,939,787 A 2/1976 Morrison et al.
3,945,334 A 3/1976 Ostrem et al.
3,949,692 A 4/1976 DeLine et al.
3,986,632 A 10/1976 Morrison et al.
3,990,376 A 11/1976 Schubert et al.
4,018,178 A 4/1977 Klein et al.
4,052,949 A 10/1977 Woodley
4,055,134 A 10/1977 Ostrem et al.
4,129,085 A 12/1978 Klein
4,215,792 A 8/1980 Klein
4,386,713 A 6/1983 Baumeyer et al.
4,394,927 A 7/1983 Zysset
4,406,378 A 9/1983 Zysset
4,455,114 A 6/1984 Zysset
4,511,299 A * 4/1985 Zysset ..... 413/12
4,540,105 A 9/1985 Wright
4,848,623 A 7/1989 Saunders et al.

(Continued)

*Primary Examiner*—Dana Ross
*Assistant Examiner*—Debra M Sullivan
(74) *Attorney, Agent, or Firm*—Knoble, Yoshida & Dunleavy, LLC

(57) ABSTRACT

An easy open end for a container includes an end panel having a score defined therein that defines a removable end panel portion. The score is preferably notched to define a bottom edge having a continuous V-shaped recess. A first double fold is defined adjacent to and positioned radially inward from the score that defines beneath the score a first outwardly projecting extending cut protection bead. A second double fold is defined adjacent to and positioned radially outward from the score that defines beneath the score a second inwardly projecting cut protection bead. The end panel is elastically deformed in an area near the score so as to define a concave depression about the score, which provides enhanced cut protection.

6 Claims, 12 Drawing Sheets

U.S. PATENT DOCUMENTS 5,038,956 A 8/1991 Saunders
5,069,356 A 12/1991 Zysset
5,252,019 A 10/1993 Saunders et al.
5,823,730 A 10/1998 La Rovere
5,927,536 A 7/1999 Oyagi et al.
6,688,832 B1 * 2/2004 Zysset ..... 413/17

* cited by examiner

PROCESS OF MAKING EASY OPEN CAN END

This is a Divisional of application Ser. No. 10/798,069, filed Mar. 11, 2004, now U.S. Pat. No. 7,147,122, the entire disclosure of which is hereby incorporated by reference as if set forth fully herein.

BACKGROUND OF THE INVENTION

1. Field of the Invention

This invention relates generally to containers, and particularly to containers of the type having an easy-open end that is designed to be opened by a pull-tab mechanism.

2. Description of the Related Technology

The term "easy open end" is used generally for that class of ends for containers that are provided with a built-in mechanism for permitting the consumer to open the container at the end for access to the ingredients within the container, without requiring the use of a can opener or other external tool. One conventional easy open end employs a pull tab having a pointed nose, the pull tab being riveted to the panel of the end so that the nose rests adjacent a weakened area along the periphery of the end panel. To open, the pull tab is rotated about the rivet, causing the nose to fracture the weakened area. Further pulling of the tab away from the end panel then causes the remainder of the weakened peripheral to rupture, thereby permitting the entire end to be opened.

One type of easy-open end that is in wide use is the so called "full-open" end, in which a peripheral score, generally circular in configuration, is formed in the end panel at or adjacent to the periphery thereof to permit its complete removal. Full-open type cans are to be distinguished from those self opening cans which have a comparatively small removable section which, when opened, provide a comparatively small hole for dispensing the product. The latter type of can end is more appropriate for packaging soda, beer, or other liquids. Full-open type cans, on the other hand, are suitable for packaging solid products such as candy, nuts, meats, or ground coffee.

One generally recognized disadvantage of easy-open ends relates to the sharp edges that result after the can end is opened and the consequential safety issues. U.S. Pat. No. 4,511,299 to Zysset addresses these issues and introduced the concept of using blunt, protective shoulders formed by folding the panel end wall near the score line. The forming method that was described in the Zysset patent, which was never successfully placed into production, is depicted in FIGS. 1 through 6. As may be seen in FIG. 1, the starting material is a planar can end blank 10. The end blank 10 is first subjected to a first forming operation to form bend 16 and a portion of a side curl 18 at the peripheral edge of the end 10. As shown in FIG. 2, the end is then subjected to a second operation bending and forming step to create a pair of concentric grooves 20, 22 which define inner and outer beads 21, 23 that extend below the second, inner surface 14 of the end 10. Also formed is a central bead 24, which extends above the level of the first, outer surface 12 of the end 10.

Referring now to FIG. 3, the end 10 was described to be subjected to another forming step wherein the portion of the end 10 inside the bead 21 is rolled upward, and the second bead 23 is extended downwardly. Thereafter, as is shown in FIG. 4, a score 28 is formed on the central bead 24, and then the inner and outer beads 21, 23 are forced toward the inside surface 14 and the central bead 24 is forced toward the outside surface 12 until the inner and outer beads 21, 23 abut the central bead 24 to provide blunt, protective shoulders underneath the score line 28 (see FIG. 5). The protective shoulders formed by the inner and outer beads 21, 23 of this double-fold configuration lie in a common plane which is substantially parallel to, but spaced from the plane of the end 10. As is shown in FIG. 6, the completed end is provided with a pull-tab 34, the extremity of which extends adjacent to the score line 28 to permit the end to be opened in a conventional manner. As may be seen in FIGS. 6 and 7, a completed end fabricated in accordance with the method shown in FIGS. 1-5 includes the central bead 24 that contains the score line which is flush with the end 10 and resides essentially in the plane of the end 10, and concentric recesses 30, 32 that surround the central bead. The recesses 30, 32 are formed by the specific bending technique described below with respect to the inner and outer beads 21, 23.

While the cut protection provided by double-fold configurations such as those disclosed in the Zysset patent is substantial, the sharp edge of an end panel that has been separated along a score line can still present a threat of finger cuts to a consumer who might unfortunately contact the edge from an unfavorable direction or orientation wherein the blunt protective shoulders of the double-fold beads fail to prevent substantial contact between the edge and the consumer's finger.

A need exists for an improved easy-open end and a process for making such an end that improves the quality of cut protection that is afforded to a consumer.

SUMMARY OF THE INVENTION

Accordingly, it is an object of the invention to provide an improved easy open end and a process for making such an end that improves the quality of cut protection that is afforded to a consumer.

In order to achieve the above and other objects of the invention, a method of making an easy-open end for a container according to a first aspect of the invention includes steps of providing a can end having a peripheral edge and a panel, the panel having opposing first and second sides with the first side adapted to face toward the inside of a container when the end is affixed thereto; forming first and second grooves in the panel spaced from the peripheral edge, the grooves extending below the level of the first side to form inner and outer beads; forming a central bead in the panel between the first and second grooves, the central bead extending above the level of the second surface; forming a score along the central bead on the second side of the panel; forcing the inner and outer beads toward each other and then toward the first surface while forcing the central bead toward the second surface, this step being performed in such a manner that the central bead elastically deforms at the score; and fixing a pull-tab to the end, the pull-tab having structure for severing the end along the score.

A method for forming a pull-tab removable end according to a second aspect of the invention includes steps of providing a metallic can end; forming inner and outer concentric beads in the end extending away from the end, the inner bead extending a greater distance away from the end than the outer bead; forming a notched score between the inner and outer beads; forcing the inner and outer beads toward each other and toward the plane of the end until the beads abut the end and the can end bends about the notched score; and fixing a pull-tab to the end, the pull-tab having means for severing the end along the score.

According to a third aspect of the invention, an easy open end for a container includes an end panel having a score defined therein defining a removable end panel portion; a first double fold defined adjacent to and positioned radially inward from the score, the first double fold defining beneath the score a first outwardly projecting extending cut protection bead; a second double fold defined adjacent to and positioned radially outward from the score, the second double fold defining beneath the score a second inwardly projecting cut protection bead; the end panel being elastically deformed in an area near the score so as to define a concave depression about the score; and a pull-tab affixed to the end panel.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
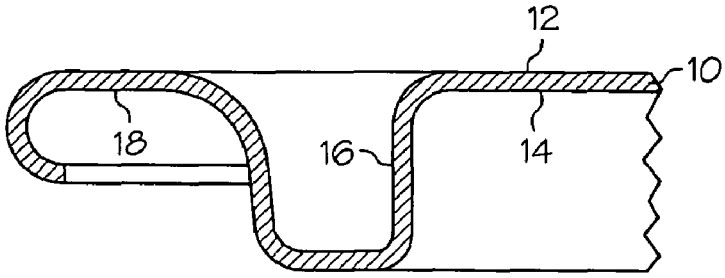
FIG. 1 (PRIOR ART)
FIGS. 1-6 are cross-sections illustrating steps in a prior art method of forming an easy-open end.
Figure 2:
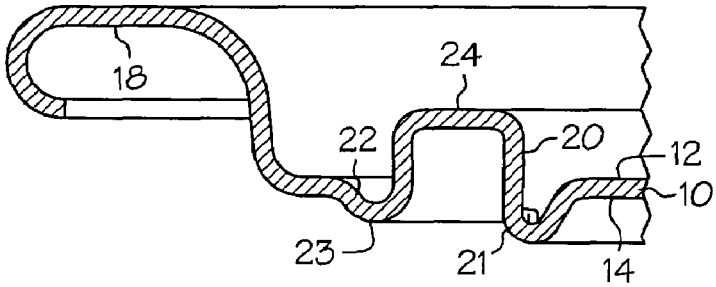
FIG. 2 (PRIOR ART)
Figure 3:
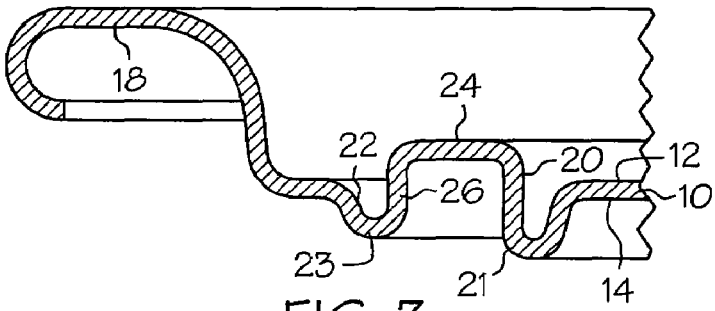
FIG. 3 (PRIOR ART)
Figure 4:
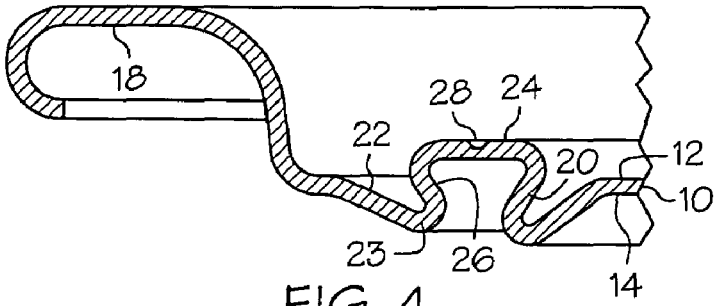
FIG. 4 (PRIOR ART)
Figure 5:
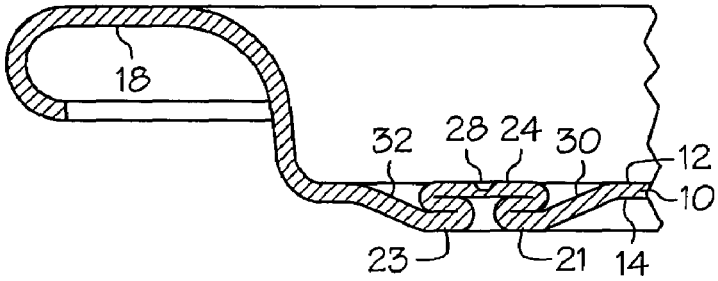
FIG. 5 (PRIOR ART)
Figure 6:
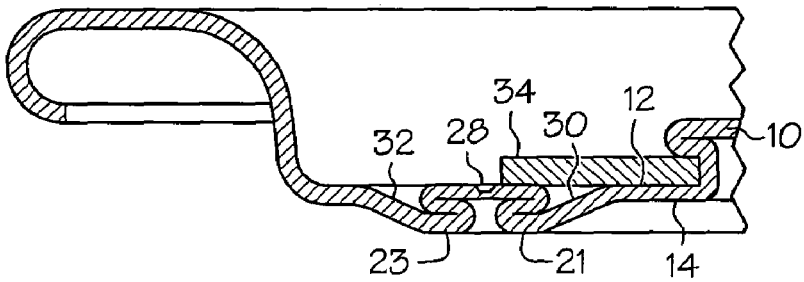
FIG. 6 (PRIOR ART)
Figure 7:
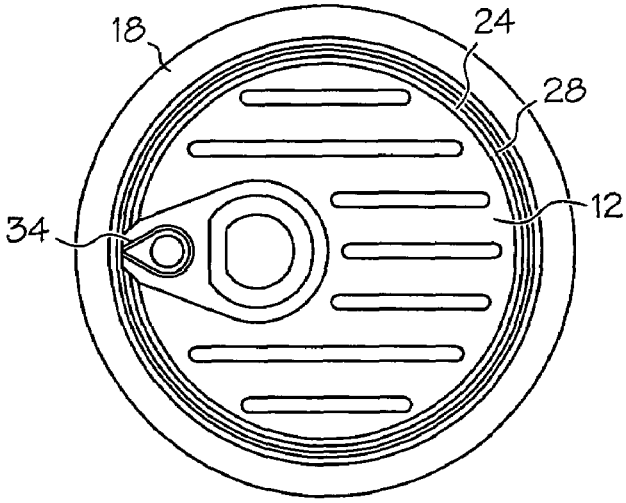
FIG. 7 (PRIOR ART)
FIG. 7 is a top plan view of a end construction in accordance with the prior art.
Figure 8:
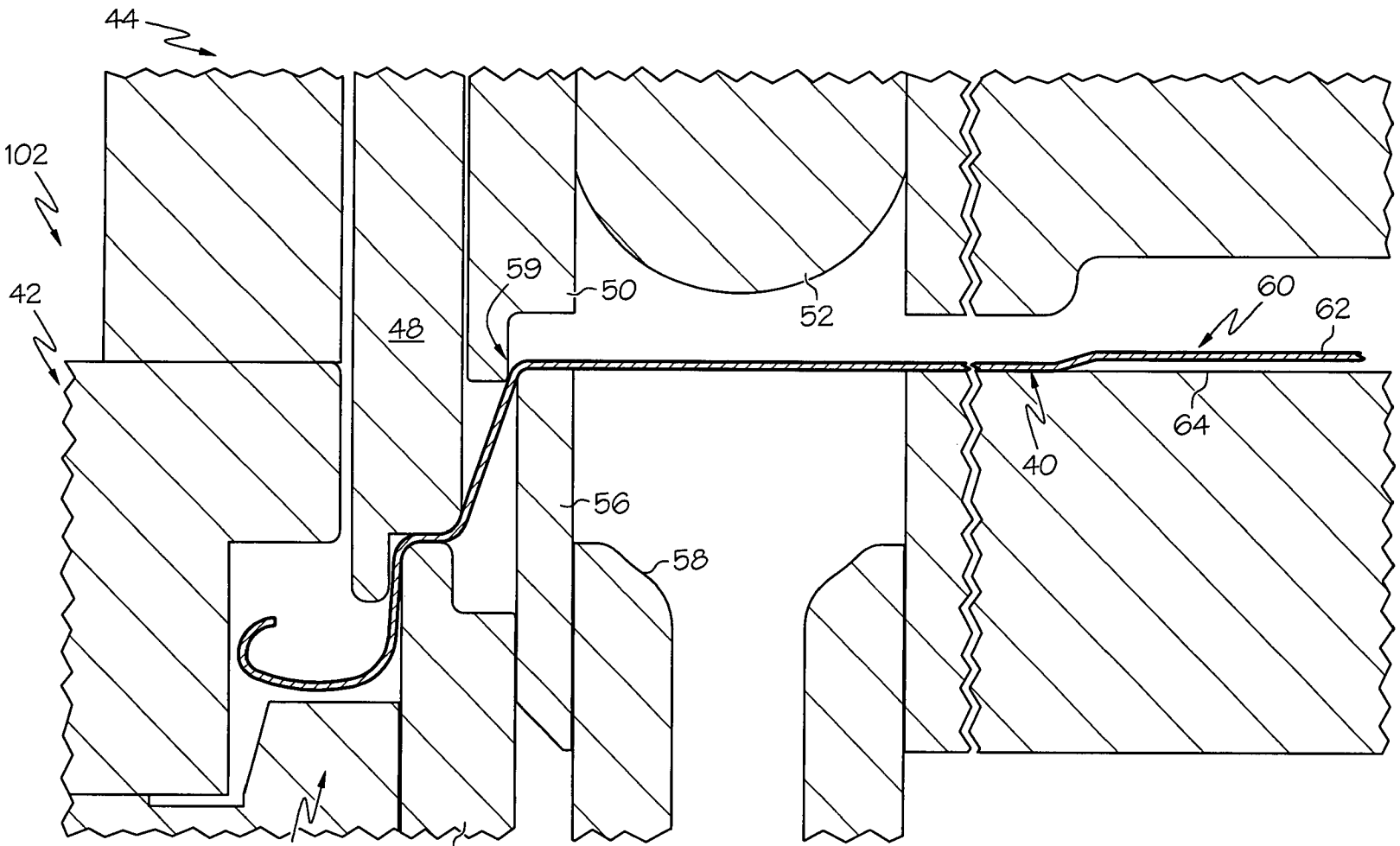
FIG. 8 is a fragmentary cross-sectional view depicting tooling for performing a first forming operation according to the preferred embodiment of the invention, shown in a first operational position.

Referring now to the drawings, wherein like reference numerals designate corresponding structure throughout the views, and referring in particular to FIG. 8, a tooling assembly 42 for performing a first forming operation according to the preferred embodiment of the invention is shown in an open preoperational position with a prepositioned metallic can end blank 40, which could be fabricated form a material such as aluminum or steel. Tooling assembly 42 includes a punch assembly 44 including an outside upper forming punch 48, a first operation bead form punch 50 and a first operation bubble punch 52. Tooling assembly 42 further includes a die assembly 46 having an outer forming die 54, a resiliently biased movable support die 56 and a first operation bubble forming die 58. As is shown in FIG. 8, the can end blank 40 includes an end panel 60 having a first side 62 that is adapted to face the inside of a container after formation of the can end is completed and a second, opposite side 64.

Figure 9:
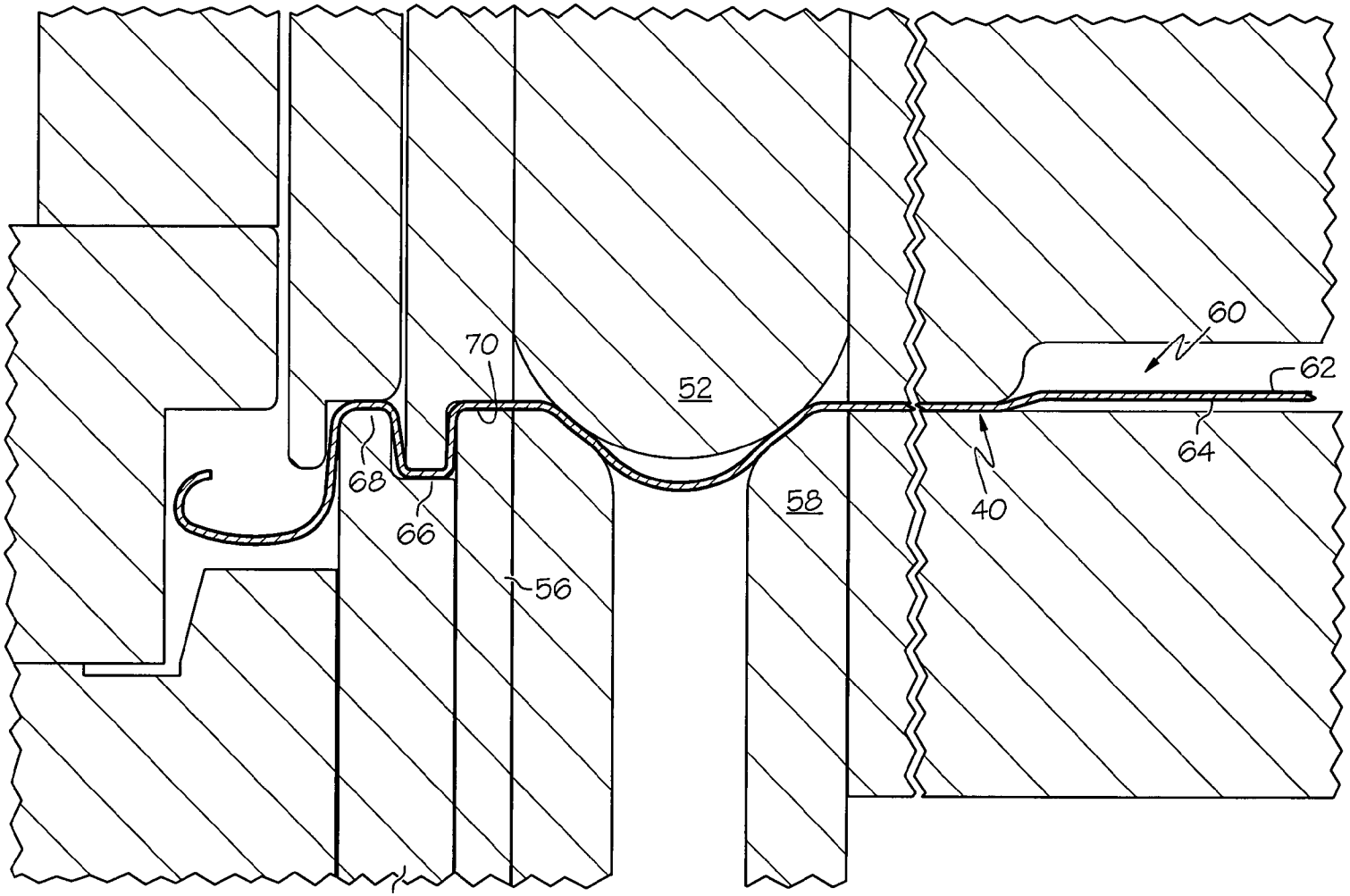
FIG. 9 is a fragmentary cross-sectional view depicting the tooling shown in FIG. 8, shown in a second operational position.

FIG. 9 depicts the tooling assembly 42 and the can end blank 40 after completion of the first-forming operation. As may be visualized from FIGS. 8 and 9, interaction of the outside upper form punch 48 and the first operation bead form punch 50 with the outer forming die 54 and the movable support die 56 forms a raised central bead 66 and the beginning of first and second grooves 68, 70 on each side of the raised central bead 66. Simultaneously, interaction of the bubble punch 52 with the first operation bubble forming die 58 forms the beginning of a bubble shape in the end panel 60 that is positioned radially inward of the central bead 66 and the grooves 68, 70. The formation of this bubble shape has the effect of preventing material draw into the area of the central bead 66 and the first and second grooves 68, 70.

Figure 10:
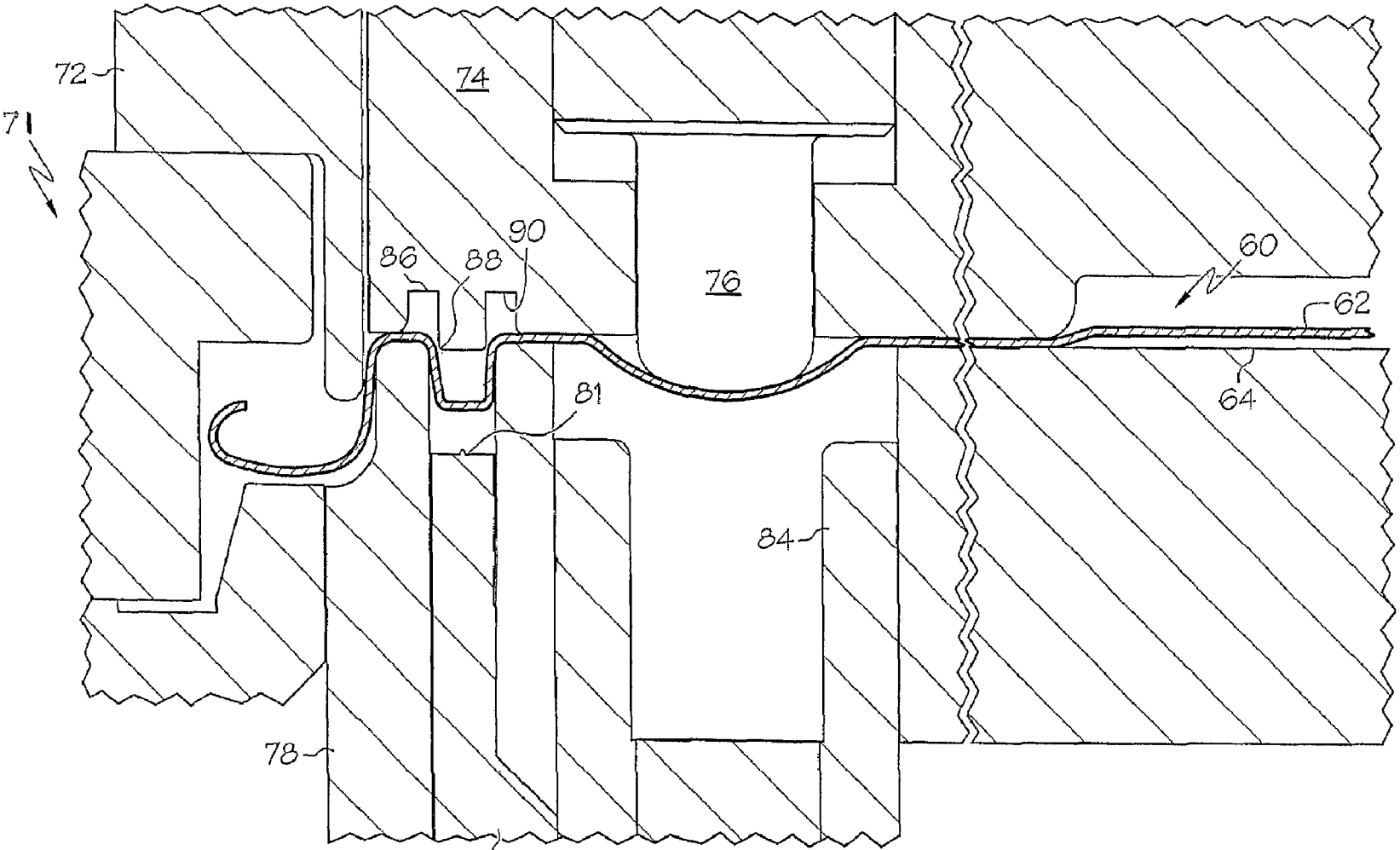
FIG. 10 is a fragmentary cross-sectional view depicting tooling for performing a second forming operation according to the preferred embodiment of the invention, shown in a first operational position.

After completion of the first forming operation, the can end blank will be moved to a second operational forming station that contains second operation tooling 71 that is depicted in FIG. 10. The second operation tooling 71 includes an outside second operation form punch 72, an inside second operation forming punch 74 and a second operation bubble forming punch 76. Second operation tooling 71 further includes an outside movable resiliently mounted forming die 78, a scoring die 80 that is provided with an upwardly extending scoring projection 81 that will be discussed in greater detail below and a second operation bubble forming die 84 that is positioned to cooperate with the second operation bubble forming punch 76. The inside second operation forming punch 74 is profiled so as to have a downwardly extending annular projection 88 having a first annular recess 86 on an outer side thereof and a second annular recess 90 on an inner side thereof.

Figure 11:
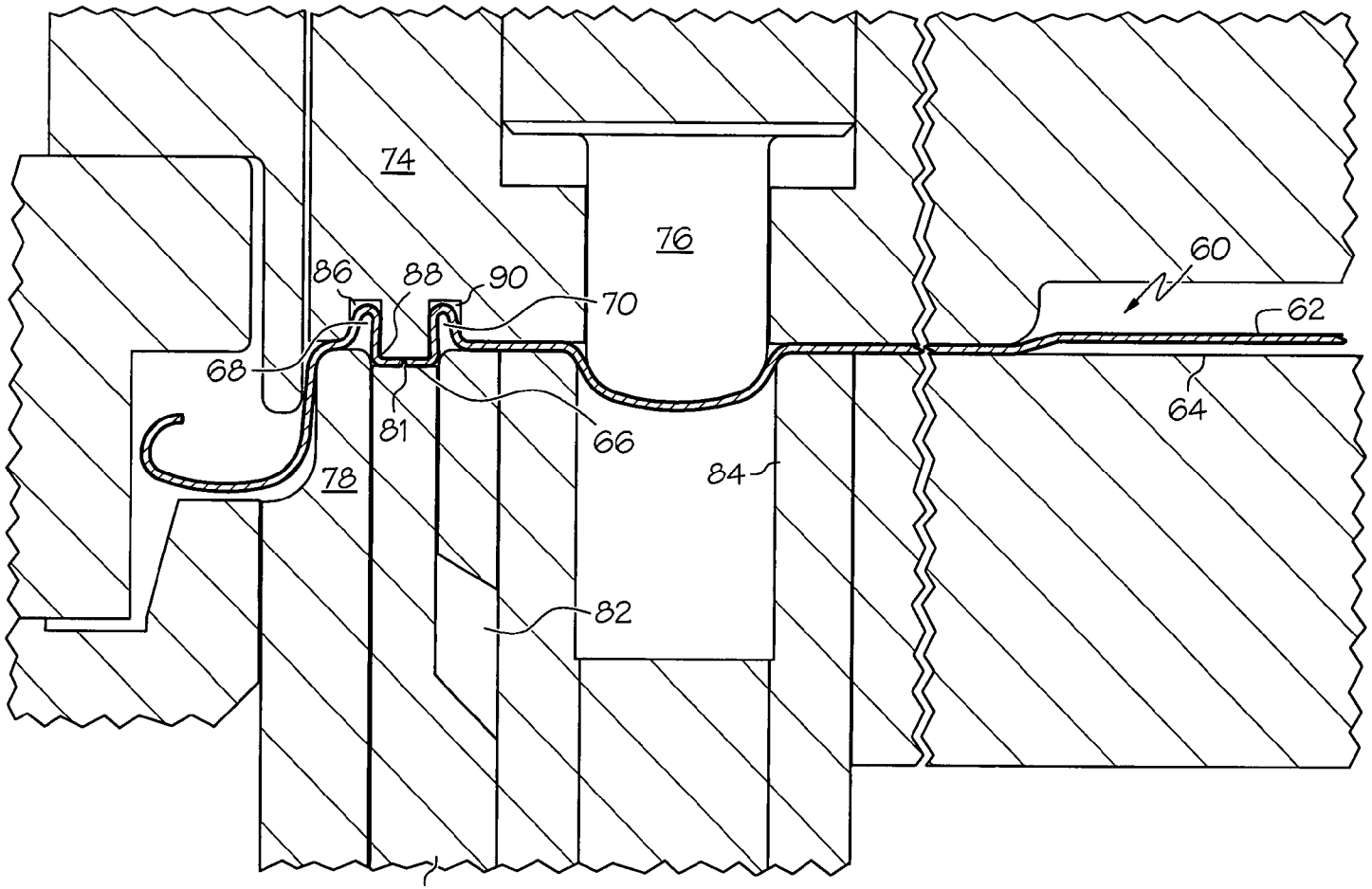
FIG. 11 is a fragmentary cross-sectional view depicting the tooling shown in FIG. 10, shown in a second operational position.
Figure 12B:
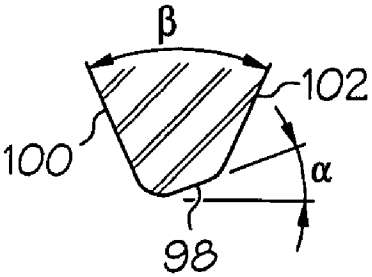
FIGS. 12(*a*)-12(*c*) are cross-sectional fragmentary depictions of a scoring projection that is used according to the preferred embodiment of the invention, shown in different states of wear.
Figure 12C:
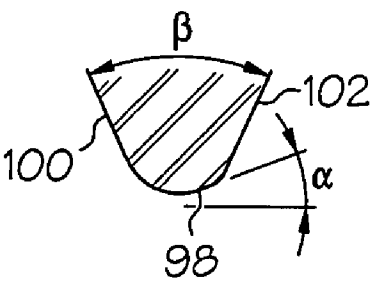
Figure 12A:
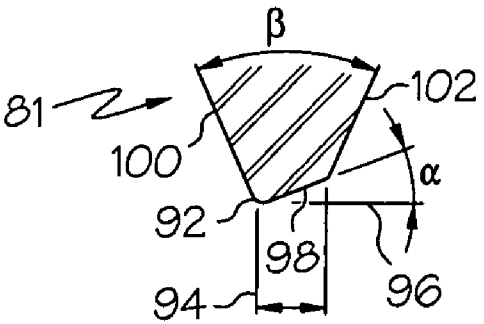

After completion of the second forming operation as depicted in FIG. 11 a score will be defined in the central bead 66 of the end panel 60 and the first and second grooves 68, 70 will become more discrete and better defined. The score is defined in the second side 64 of the end panel 60. According to the preferred embodiment of the invention, the score is notched, meaning for purposes of this document that the bottom of the score is not flat but is grooved in order to induce bending, crimping or flexure of the end panel 60 in the area of the central bead 66 during subsequent forming operations. FIG. 12(*a*) depicts a scoring projection 81 that is constructed according to a preferred mode of the invention and that is tapered to a continuous edge 92 that will define a continuous groove or notch in the bottom of the score that is formed thereby. Preferably, this continuous edge 92 when the tooling is new has a radius that is no greater than 0.0002 inches. FIG. 12(*a*) depicts a vertical plane 94 that is perpendicular to a horizontal plane 96 in which the end panel 60 generally resides. Edge 92 is defined as the intersection of a first annular surface 98 that resides substantially within a plane that is at an angle a with respect to the horizontal plane 96 and a second surface 100. Preferably, the angle a is within a range of about 17 degrees to about 23 degrees. Projection 81 is further defined by a third annular surface 102 that resides within a third plane that is angled with respect to the second surface 100 at an angle β that is preferably within a range of about 47 degrees to about 53 degrees. FIG. 12(*b*) depicts the scoring projection 81 after it has experienced a moderate amount of wear, while FIG. 12(*c*) shows the scoring projection 81 after an unacceptable amount of wear. As may be seen from these figures, the unique shape of the projection 81 will ensure that it retains a notched profile during its useful life. Preferably, the continuous edge 92 when the tooling is considered unacceptably worn has a radius that is no greater than 0.0005 inches.

Figure 13:
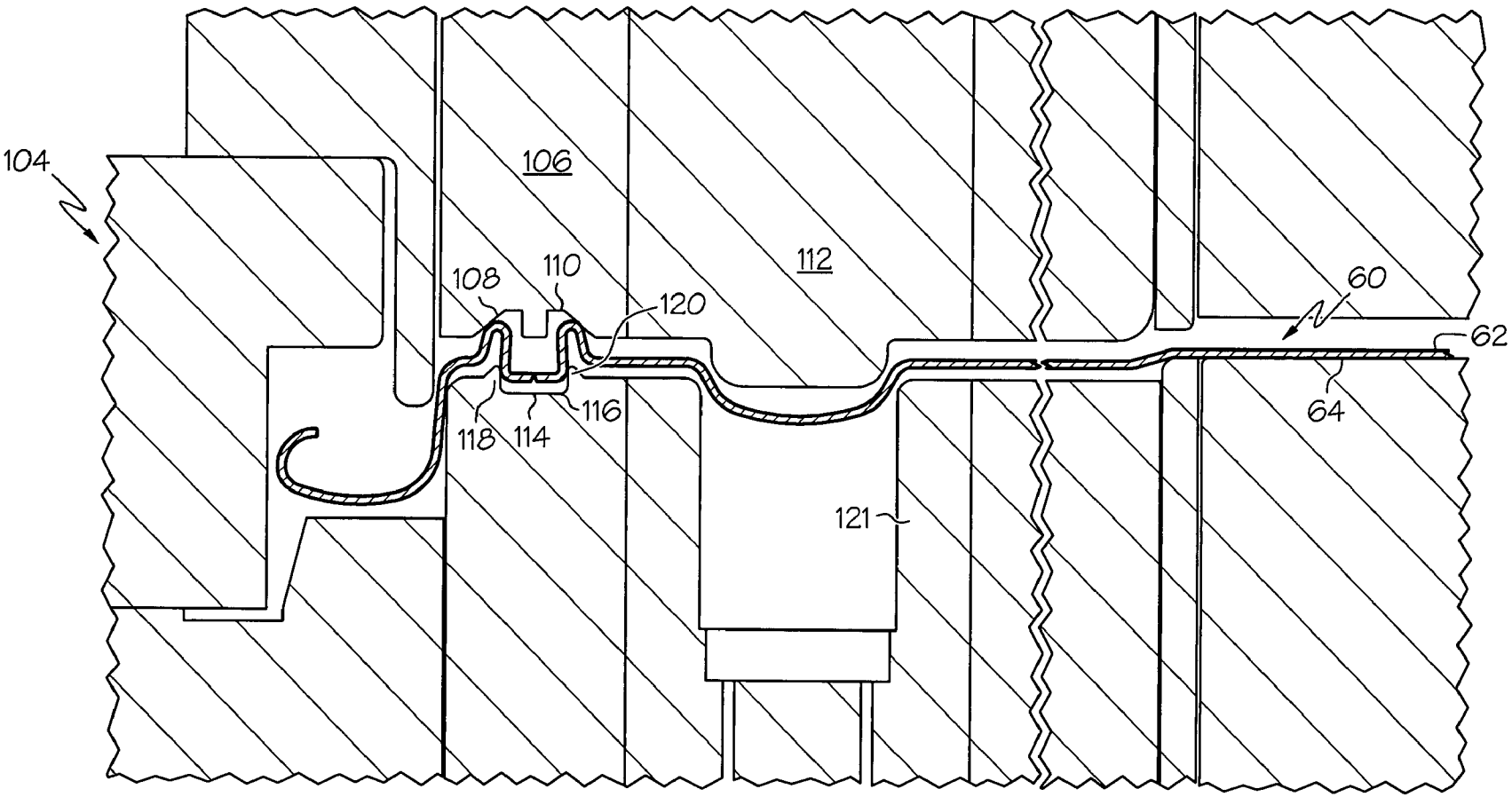
FIG. 13 is a fragmentary cross-sectional view depicting tooling for performing a third forming operation according to the preferred embodiment of the invention, shown in a first operational position.

FIG. 13 depicts a tooling assembly 104 that is used for performing a third forming operation according to the preferred embodiment of the invention. Third operation tooling 104 includes a cam punch 106 that includes first and second inwardly angled cam surfaces 108, 110 and a third operation bubble punch 112. The third operation die tooling includes a gripper die tool 114 defining an annular recess 116 that is bounded by an outer annular projection 118 and an inner annular projection 120. A third operation bubble forming die 121 is also provided.

Figure 14:
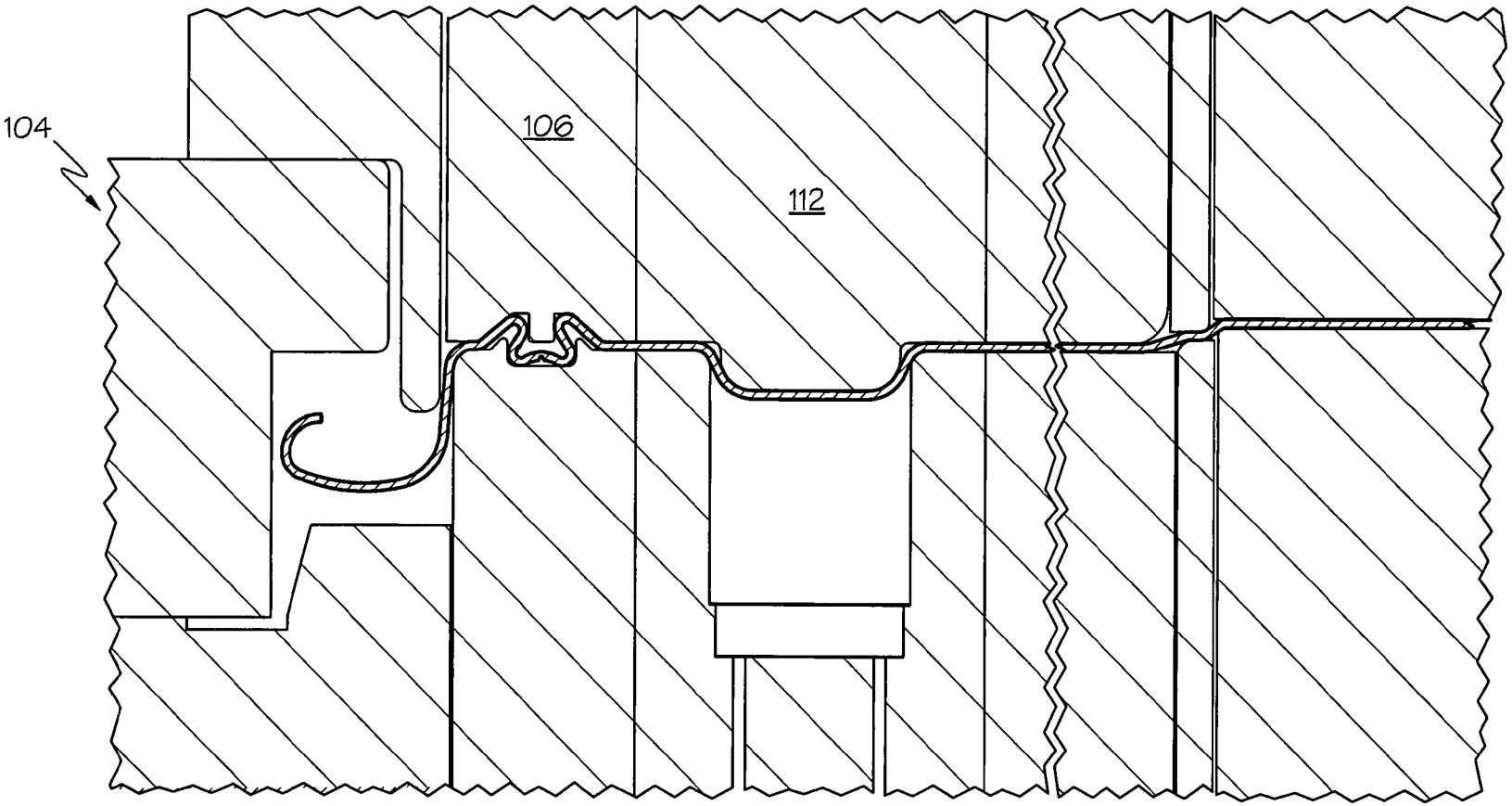
FIG. 14 is a fragmentary cross-sectional view depicting the tooling shown in FIG. 13, shown in a second operational position.

Referring now to FIG. 14, as the third operation is performed the beads that are defined in the end panel 60 forming the first and second grooves 68, 70 are pushed downwardly and toward each other by interaction with the cam surfaces 108, 110 of the cam punch 106. As this occurs, the scored central bead 66, which is constrained within the recess 116 by contact with the outer and inner annular projections 118, 120 of the gripper die 114, will begin to elastically deform by bending or crimping at the location of the score 82 so as to form an annular concave recess on the second side 64 of the end panel 60 in the area of the central bead 66 that is adjacent to the notched score 82. This bending or crimping effect creates important cut protection advantages because it insures that the rough edges that are formed upon rupture of the score 82 upon opening of the can end will be angled in the direction of the cut protection beads, as will be described in more detail below.

Figure 15:
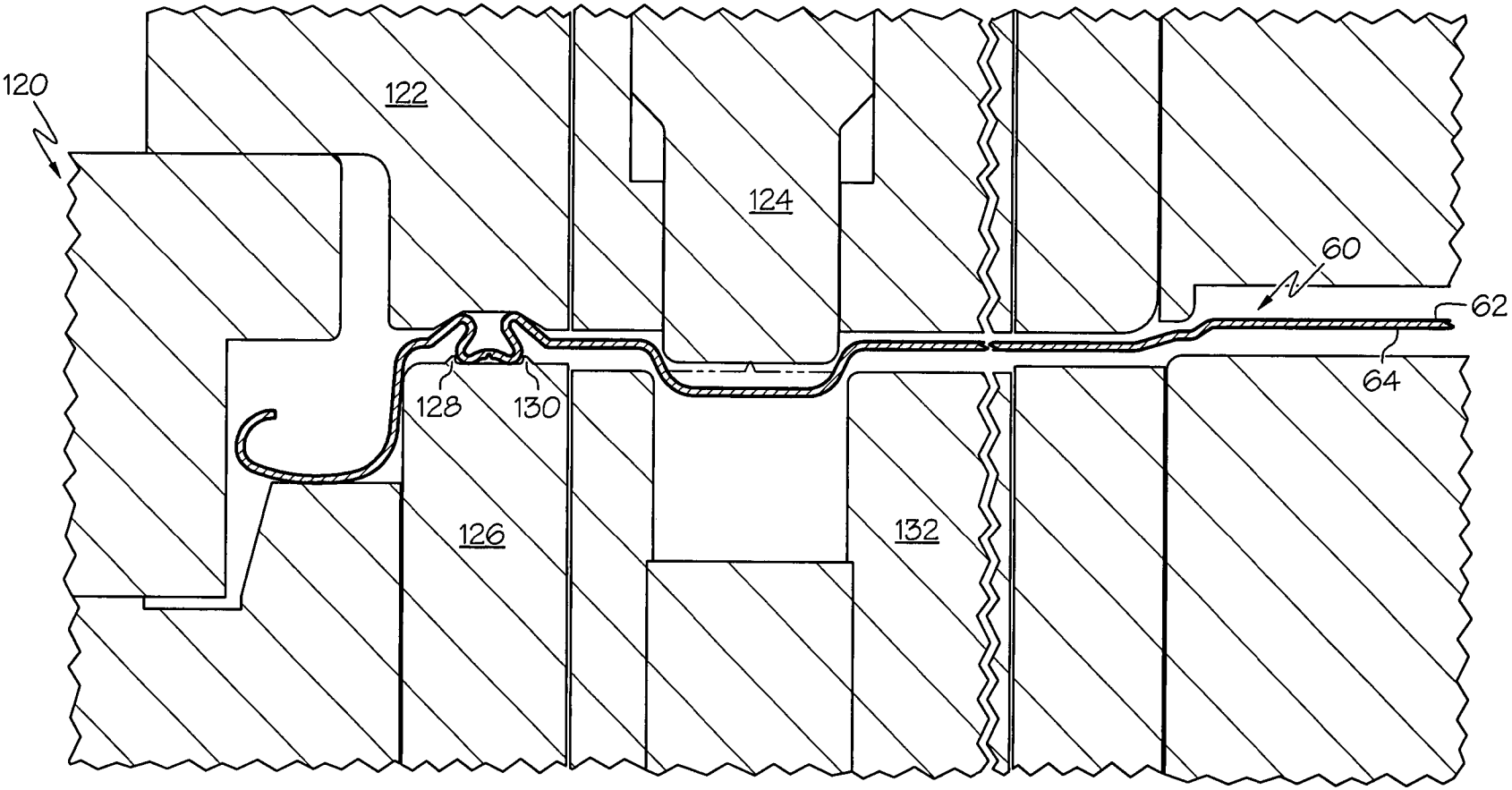
FIG. 15 is a fragmentary cross-sectional view depicting tooling for performing a fourth forming operation according to the preferred embodiment of the invention, shown in a first operational position.
Figure 16:
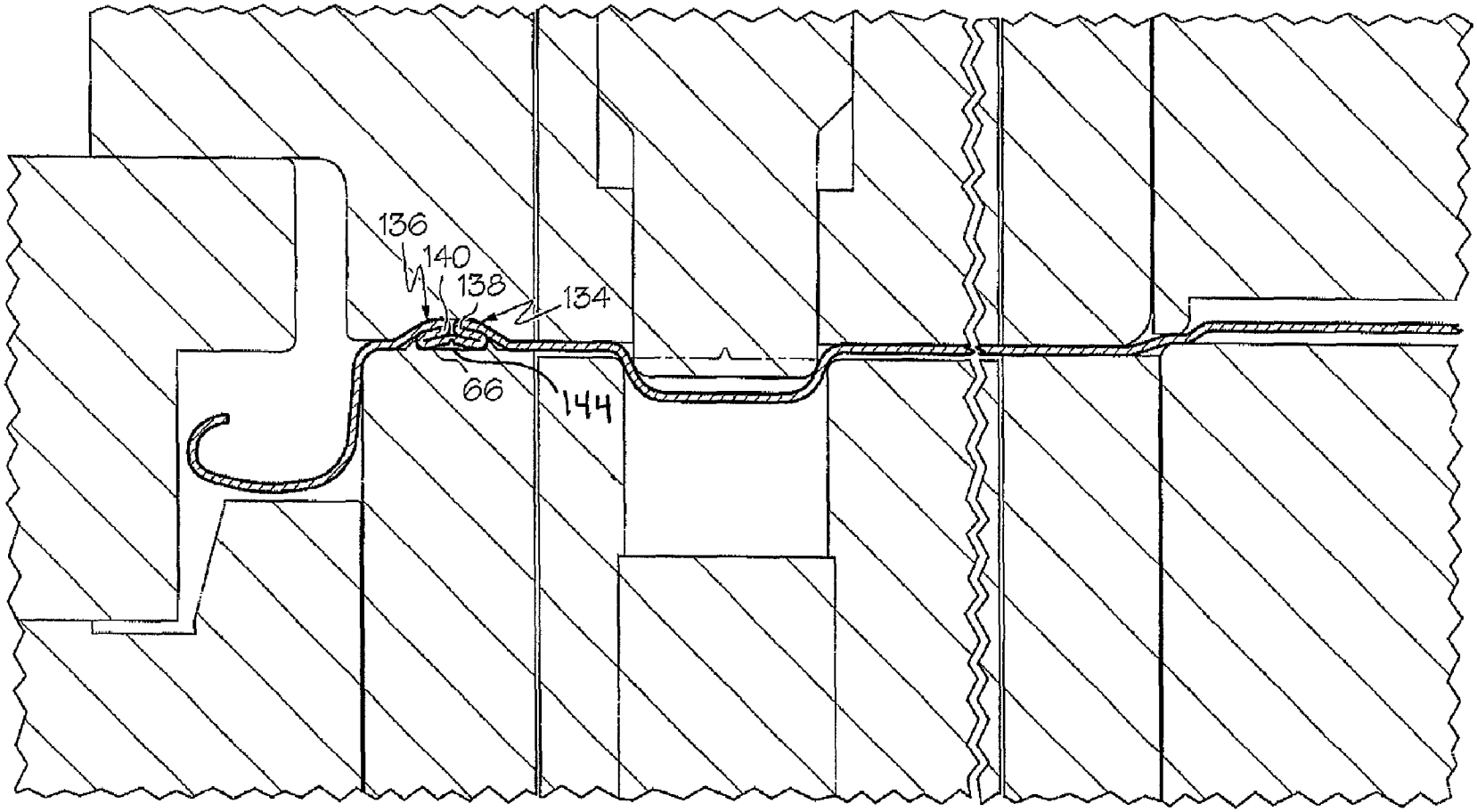
FIG. 16 is a fragmentary cross-sectional view showing the tooling of FIG. 15, shown in a second operational position.

The fourth forming operation that is depicted in FIGS. 15 and 16 utilizes for the operation tooling 120 including a compression punch 122, a fourth operation bubble forming punch 124 and a fourth operation gripper die 126 having outer and inner annular projections 128, 130 for constraining the scored, elastically deformed central bead 66 during this forming operation. Tooling 120 further includes a fourth operation bubble forming die 132. During the fourth forming operation, the part of the end panel defining the central bead 66 and the first and second grooves 68, 70 is further compressed, forming a first double fold 134 that is defined adjacent to and positioned radially inward from the score 82 and a second double fold 136 that is defined adjacent to and positioned radially outward from the score 82. The first double fold 134 defines beneath the score 82 a first outwardly projecting extending cut protection bead 138, while the second double fold 136 defines beneath the score 82 a second inwardly projecting cut protection bead 140.

Figure 17:
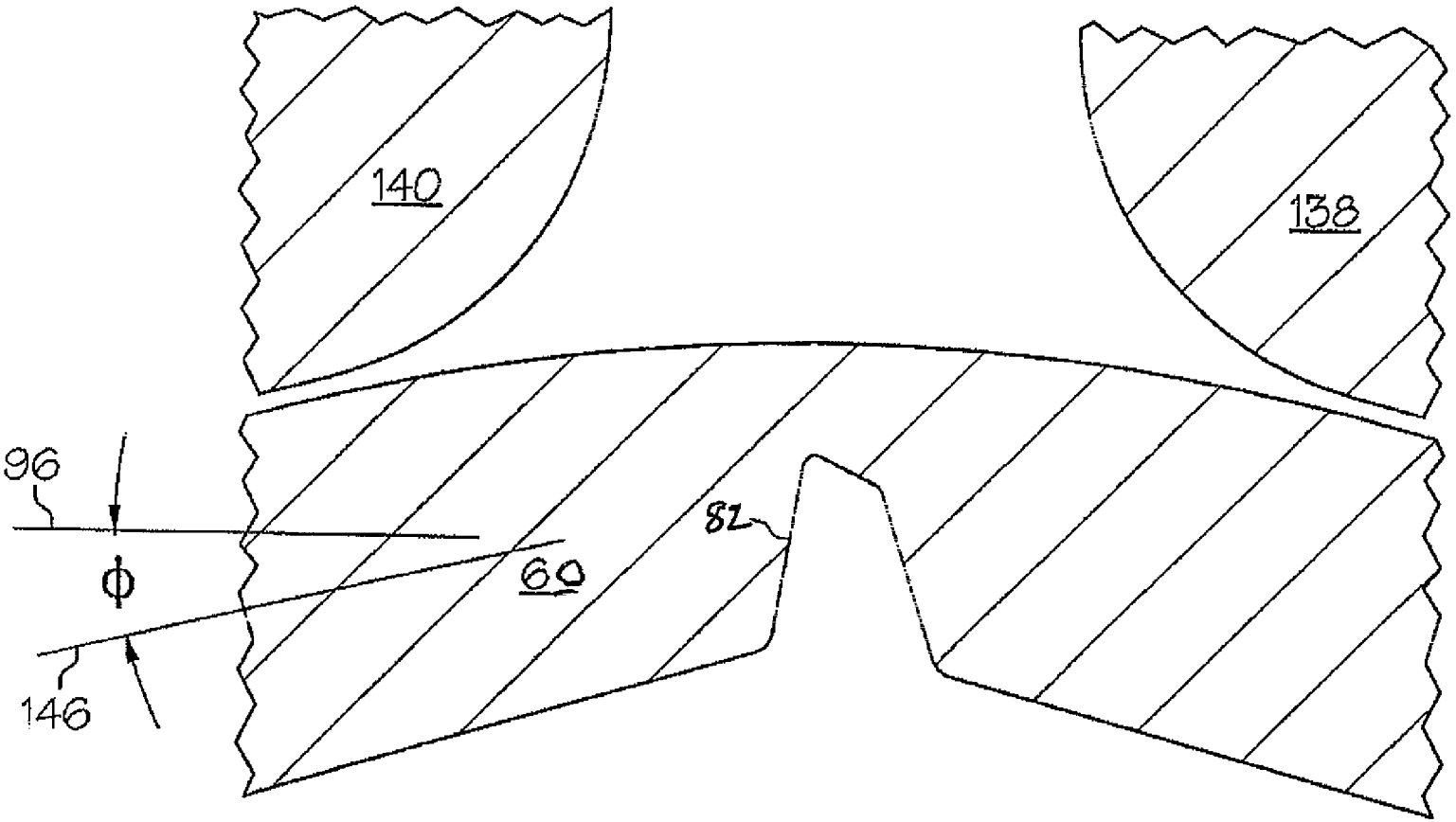
FIG. 17 is an annotated micrograph depicting a critical portion of an easy open can end that is constructed according to a preferred embodiment of the invention.

FIG. 17 is based upon a micrograph of the region adjacent to the score 82 after completion of the fourth forming operation. The concave recess 144 that is defined by the bending or crimping of the end panel 60 about the score 82 is clearly shown. In this elastically deformed area, the portion of the end panel 60 that is immediately adjacent to the score 82 resides within a plane 146 that is angled with respect to the horizontal plane 96 in which the main body of the end panel 60 resides by an angle Φ, which is preferably approximately within a range of about 3 degrees to about 20 degrees, and more preferably within a range of about 8 degrees to about 18 degrees. By viewing FIG. 17 it can easily be visualized how upon rupture of the end panel 60 at the score line 82 the ensuing rough edges will be angled inwardly toward the respective inwardly and outwardly extending cut protection beads 140, 138. This reduces the exposure of the consumer to the rough edges and increases the degree of safety that is provided by the cut protection of the double folds 134, 136.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making an easy-open end for a container, comprising steps of:

(a) providing a can end having a peripheral edge and a panel, said panel having opposing first and second sides with said first side adapted to face toward the inside of a container when said end is affixed thereto;

(b) forming first and second grooves in said panel spaced from said peripheral edge, said grooves extending below the level of said first side to form inner and outer beads;

(c) forming a central bead in said panel between said first and second grooves, said central bead extending above the level of said second side;

(d) forming a score along said central bead on said second side of said panel;

(e) forcing said inner and outer beads toward each other and then toward said first side while forcing said central bead toward said second side, this step being performed in such a manner that said central bead elastically deforms in such a manner that said central bead will bend at said score.

2. A method of making an easy open end for a container according to claim 1, wherein step (e) is performed in such a manner that said central bead will bend concavely about said score.

3. A method of making an easy open end for a container according to claim 1, wherein said step of forming a score along said central bead on said second side of said panel comprises forming a score having a notched bottom, whereby elastic deformation of said central bead at said score during step (e) is promoted.

4. A method of making an easy open end for a container according to claim 3, wherein said notched bottom is tapered to a continuous V-shaped recess.

5. A method of making an easy open end for a container according to claim 1, wherein step (b) is performed by forming first and second concentric grooves in said panel spaced from said peripheral edge.

6. An easy-open end that is made according to claim 1.

* * * * *